US012465145B2

(12) United States Patent
Shih

(10) Patent No.: US 12,465,145 B2
(45) Date of Patent: Nov. 11, 2025

(54) BASE SEAT FOR BED, CHAIR OR SOFA

(71) Applicant: RUOEY LUNG ENTERPRISE CORP., Changhua County (TW)

(72) Inventor: Lung-Tan Shih, Changhua County (TW)

(73) Assignee: RUOEY LUNG ENTERPRISE CORP., Lukang Township, Changhua County (TW)

( * ) Notice: Subject to any disclaimer, the term of this patent is extended or adjusted under 35 U.S.C. 154(b) by 220 days.

(21) Appl. No.: 18/534,999

(22) Filed: Dec. 11, 2023

(65) Prior Publication Data

US 2025/0185808 A1 Jun. 12, 2025

(51) Int. Cl.
*A47C 3/02* (2006.01)

(52) U.S. Cl.
CPC ..... *A47C 3/02* (2013.01)

(58) Field of Classification Search
CPC ..... A47C 3/02; A47C 3/0257; A47C 17/04
USPC ..... 248/420, 421, 424; 296/65.13, 65.14
See application file for complete search history.

(56) References Cited

U.S. PATENT DOCUMENTS 6,669,290 B1 * 12/2003 Pugh ..... A47C 3/029 297/259.1
7,100,975 B1 * 9/2006 Zheng ..... A47C 4/286 297/32
2019/0298064 A1 * 10/2019 Shih ..... A47C 3/0255

* cited by examiner

*Primary Examiner* — Todd M Epps
(74) *Attorney, Agent, or Firm* — Birch, Stewart, Kolasch & Birch, LLP

(57) ABSTRACT

A base seat for being used with a bed, a chair, or a sofa includes a fixation base provided thereon with two longitudinal wheel sets, a first rocking frame having two longitudinal arc rails in contact with the longitudinal wheel sets and two transverse wheel sets thereon, a second rocking frame including two transverse arc rails in contact with the transverse wheel sets, a first actuator disposed to the fixation base to drive the first rocking frame to reciprocatingly move back and forth while changing its angle, and a second actuator disposed to the first rocking frame to drive the second rocking frame to reciprocatingly move left and right while changing its angle. As a result, the base seat can generate multi-directional swinging motion, preventing users from feeling fatigued. Further, the swinging motion is smooth to effectively minimize the jerkiness during changes in swinging direction.

11 Claims, 7 Drawing Sheets

BASE SEAT FOR BED, CHAIR OR SOFA

BACKGROUND OF THE INVENTION

1. Field of the Invention

The present invention relates generally to a furniture and more particularly, to a base seat adapted for being used with a bed, a chair, or a sofa.

2. Description of the Related Art

Conventional swingable beds or rocking chairs are generally swingable back and forth or from side to side, i.e., swinging in a single direction. Prolonged mechanical movements in a single direction can make users feel bored and unable to truly relax. Additionally, when a power source drives the bed or chair to reciprocatingly swing through a transmission mechanism, dimensional tolerances existed between components often lead to jerkiness during changes in motion direction. Especially, as components gradually wear out, the aforesaid jerkiness will become more and more noticeable.

Furthermore, although the conventional structures may handle normal usage conditions, when users intend to relocate the conventional rocking beds or chairs or when children intentionally play by pulling or tugging the conventional rocking beds or chairs, the swinging mechanism of the rocking beds or chairs may exceed the original design's range of motion. This not only may result in damage to the mechanism but may also lead to structural disintegration or harm to individuals.

SUMMARY OF THE INVENTION

The present invention has been accomplished in view of the above-noted circumstances. It is an objective of the present invention to provide a base seat for being used with a bed, chair or sofa, which can generate multi-directional swinging motion, preventing users from feeling fatigued, and can provide a smooth swinging motion to effectively minimize jerkiness during changes in motion direction.

Another objective of the present invention is to provide a base seat for being used with a bed, chair, or sofa, which can provide excellent safety to minimize the risk of mechanical damage or structural disintegration caused by inadvertent and/For error operation.

To attain the above objectives, the present invention provides a base seat, which is adapted for being used with a bed, a chair, or a sofa, comprising a fixation base, a first rocking frame, a second rocking frame, a first actuator, and a second actuator The fixation base is provided thereon with two longitudinal wheel sets arranged in a back-and-forth direction. Each of the longitudinal wheel sets comprises two longitudinal support wheels. The first rocking frame comprises two longitudinal arc rails extending in the back-and-forth direction and being in contact with top sides of the longitudinal support wheels, and a first upright guide groove. On the first rocking frame, two transverse wheel sets are arranged in a left-and-right direction and each comprise two transverse support wheels. The second rocking frame comprises two transverse arc rails extending in the left-and-right direction and being in contact with top sides of the transverse support wheels, and a second upright guide groove. The first actuator is disposed to the fixation base and provided with a first output shaft, a first slider disposed in the first upright guide groove, and a first crank connected between the first output shaft and the first slider, such that the first actuator drives the first rocking frame to reciprocatingly move back and forth relative to the fixation base while changing an angle of the first rocking frame. The second actuator is disposed to the first rocking frame and provided with a second output shaft, a second slider disposed in the second upright guide groove, and a second crank connected between the second output shaft and the second slider, such that the second actuator drives the second rocking frame to reciprocatingly move left and right relative to the first rocking frame while changing an angle of the second rocking frame.

As a result, the base seat can generate multi-directional swinging motion, preventing users from feeling fatigued. Further, the swinging motion is smooth to effectively minimize the jerkiness during changes in swinging direction. At the same time, the base seat provides excellent safety, minimizing the risk of mechanical damage or structural disintegration caused by inadvertent and/or error operation.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
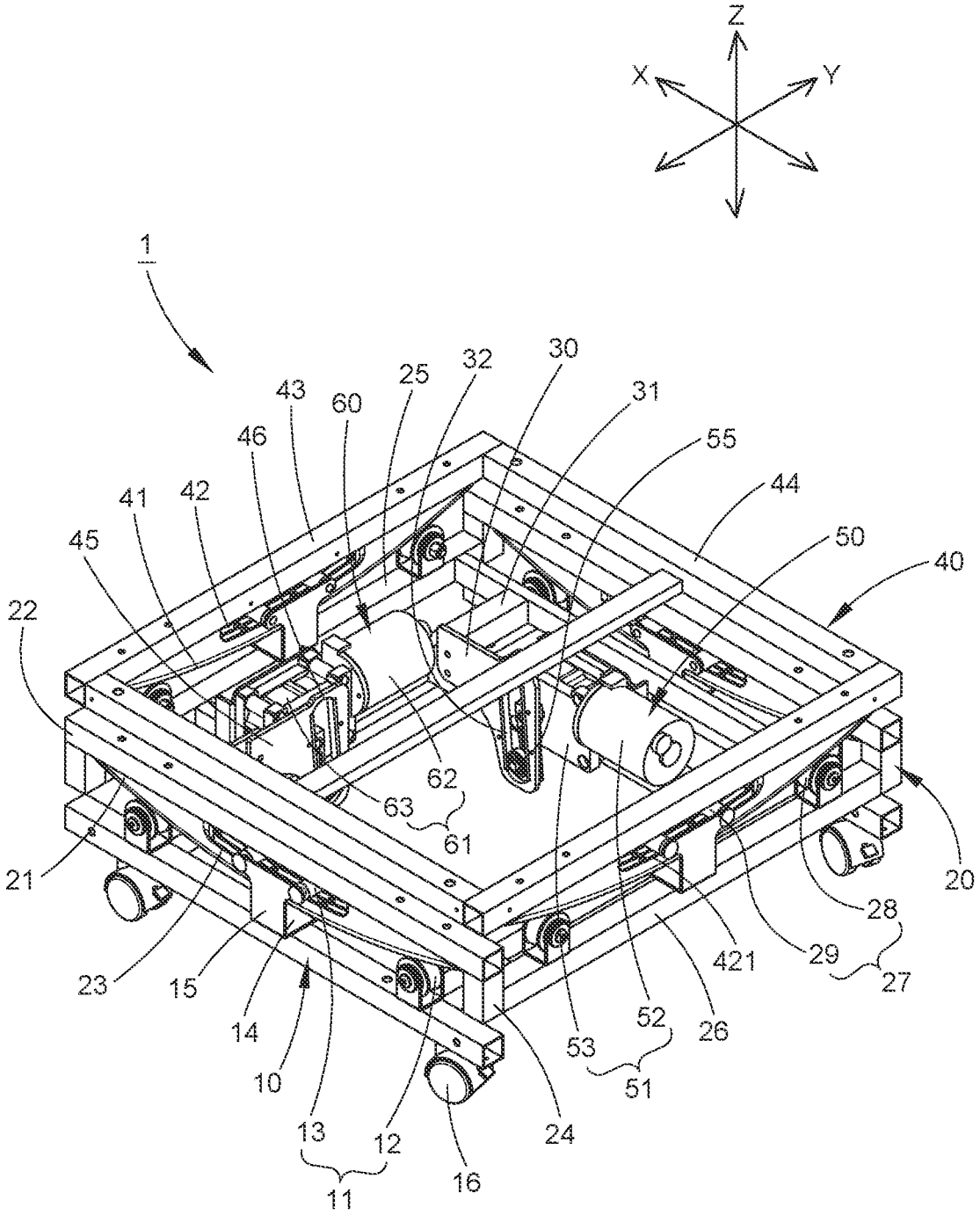
FIG. 1 is a perspective view of a base seat according to an embodiment of the present invention.
Figure 2:
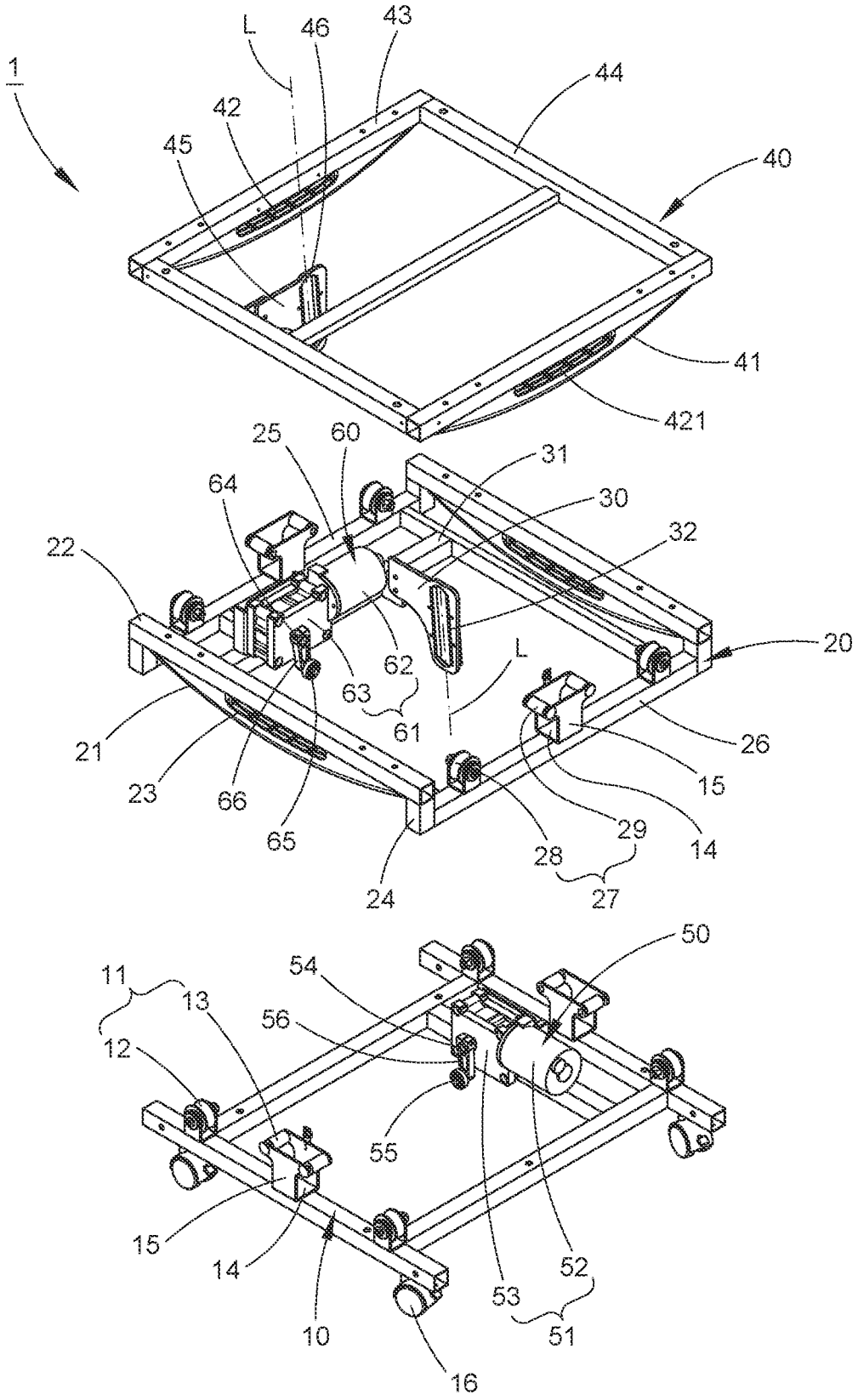
FIG. 2 is an exploded view of the base seat of the embodiment of the present invention.

The structure and technical features of the present invention will be detailedly described hereunder by a preferred embodiment and accompany drawings. FIGS. 1-2 show a base seat 1 for providing swinging motions in various directions for a bed (not shown), a chair (not shown) or a sofa (not shown) fixedly positioned thereon. The base seat 1 comprises a fixation base 10, a first rocking frame 20, a second rocking frame 40, a first actuator 50, and a second actuator 60. For ease of illustration, the directions mentioned in the present application are represented by arrows shown on the top side of FIG. 1, denoting the back-and-forth direction X, left-and-right direction Y, and up-and-down direction Z. However, the directions themselves should not be considered as limitations to the scope of the patent application.

The fixation base 10 is generally in the form of a rectangular frame, on which two longitudinal wheel sets 11 arranged in the back-and-forth direction X. Each of the longitudinal wheel sets 11 includes two longitudinal support wheels 12 and two longitudinal limit wheels 13 located between the two longitudinal support wheels 12. The longitudinal limit wheels 13 are supported by a U-shaped frame 14 set on the fixation base 10 in a way that positions of the longitudinal limit wheels 13 are slightly higher than that of the longitudinal support wheels 12. The U-shaped frame 14 has two side walls 15 for the pivotal installation of the longitudinal limit wheels 13. Below the fixation base 10, there are four casters 16 for ease of movement on the ground or other surfaces. In another embodiment, these casters 16 may be omitted. In another embodiment, the shape of the fixation base 10 may vary, and the number of longitudinal support wheels 12 may be increased. Each longitudinal wheel set 11 may include one or more longitudinal limit wheels 13.

The first rocking frame 20 is positioned above the fixation base 10 and can swing back and forth relative to the fixation base 10 (i.e., reciprocating movement back and forth while changing the angle). The first rocking frame 20 is basically a rectangular frame, which comprises two longitudinal arc rails 21 extending in the back-and-forth direction X and being in connect with the top sides of the longitudinal support wheels 12, two parallel upper rods 22 connected with the top sides of the two longitudinal arc rails 21, two longitudinal grooves 23 located above the two longitudinal arc rails 21 for accommodating the longitudinal limit wheels 13, four downwardly extending portions 24 extending downward from the two ends of the two upper rods 22, a front rod 25 connected with two of the downwardly extending portions 24 in the front, a rear rod 26 connected with the other two downwardly extending portions 24 in the rear, two transverse wheel sets 27 extending in the left-and-right direction Y and being respectively disposed on the front rod 25 and the rear rod 26, a first upright plate 30 perpendicular to the left-and-right direction Y and disposed between the two upper rods 22 by a linkage 31, and a first upright guide groove 32 provided at the first upright plate 30.

The bottom edge of the longitudinal are rail 21 is convex downward. The two longitudinal grooves 23 are located between the two longitudinal are rails 21 and the two upper rods 22, respectively. The bottom 231 of the longitudinal groove 23 is curved to correspond in shape to the arc shape of the longitudinal arc rail 21 for being contacted with the longitudinal limit wheels 13. Due to the respective contacts of the bottom edge of the longitudinal are rail 21 and the bottom 231 of the longitudinal groove 23 with the longitudinal support wheels 12 and the longitudinal limit wheels 13, and the lateral constraint provided by the side walls 15 of the U-shaped frames 14, the structure is stable and can prevent the accidental detachment of the first rocking frame 20 from the fixation base 10. Each transverse wheel set 27 includes two transverse support wheels 28 and two transverse limit wheels 29 located between the two transverse support wheels 28. The transverse limit wheels 29 are also supported by a U-shaped frame 14 set on the front rod 25 and the rear rod 26, and the positions of transverse limit wheels 29 are slightly higher than that of the transverse support wheels 28. Therefore, the first rocking frame 20 can smoothly reciprocatingly swing back and forth relative to the fixation base 10, and the swinging trajectory is similar to the pendulum motion formed by fixing the first rocking frame 20 at a point above it with a rope, giving users a feeling as if they are in a cradle. The first upright guide groove 32 extends along a straight line, and its length direction L forms an included angle of 5° with the plumb line (i.e., the up-and-down direction Z). In another embodiment, the two longitudinal limit wheels 13 may be only located in the longitudinal groove 23 without contacting the bottom 231. The structure of the downwardly extending portions 24 can reduce the height of the second rocking frame 40, making the overall structure of the base seat 1 more compact and reducing the space it occupies. However, the structure of the first rocking frame 20 is not limited to this design.

The second rocking frame 40 is positioned above the first rocking frame 20 and can reciprocatingly swing left and right relative to the first rocking frame 20 (i.e., reciprocatingly moving back and forth while changing the angle). The second rocking frame 40 is basically a rectangular frame for connecting a bed, chair, or sofa. The second rocking frame 40 comprises two transverse arc rails 41 extending in the left-and-right direction and being in connect with the top sides of the transverse support wheels 28, two transverse grooves 42 located above the two transverse arc rails 41 for accommodating the two transverse limit wheels 29, two transverse rods 43 connected with the top sides of the two transverse arc rails 41, and two longitudinal rods 44 connected with the two ends of the two transverse rods 43, a second upright plate 45 perpendicular to the back-and-forth direction X and disposed on one of the longitudinal rods 44 on the left, and a second upright guide groove 46 provided at the second upright plate 45.

The bottom edge of the transverse arc rail 41 is convex downward. The two transverse grooves 42 are located between the two transverse arc rails 41 and the two transverse rods 43, respectively. The bottom 421 of the transverse groove 42 is curved to correspond in shape to the arc shape of the transverse arc rail 41 for being contacted with the transverse limit wheels 29. Since the bottom edges of the transverse arc rails 41 and the bottoms 421 of the transverse grooves 42 are contacted with the transverse support wheels 28 and the transverse limit wheels 29 respectively, and the side walls 15 of the U-shaped frame 14 provide lateral constraint, the structure is stable and can prevent the second rocking frame 40 from accidentally detaching from the first rocking frame 20. With this arrangement, the second rocking frame 40 can smoothly reciprocatingly swing left and right relative to the first rocking frame 20, and the swinging trajectory is similar to that of the first rocking frame 20, allowing the users to feel as if they are in a cradle. The second upright guide groove 46 extends along a straight line, and its length direction L defines an included angle of 5° with the plumb line (i.e., the up-and-down direction Z). In another embodiment, the two transverse limit wheels 29 may be only located in the transverse groove 42 without contacting the bottom 421.

Figure 3:
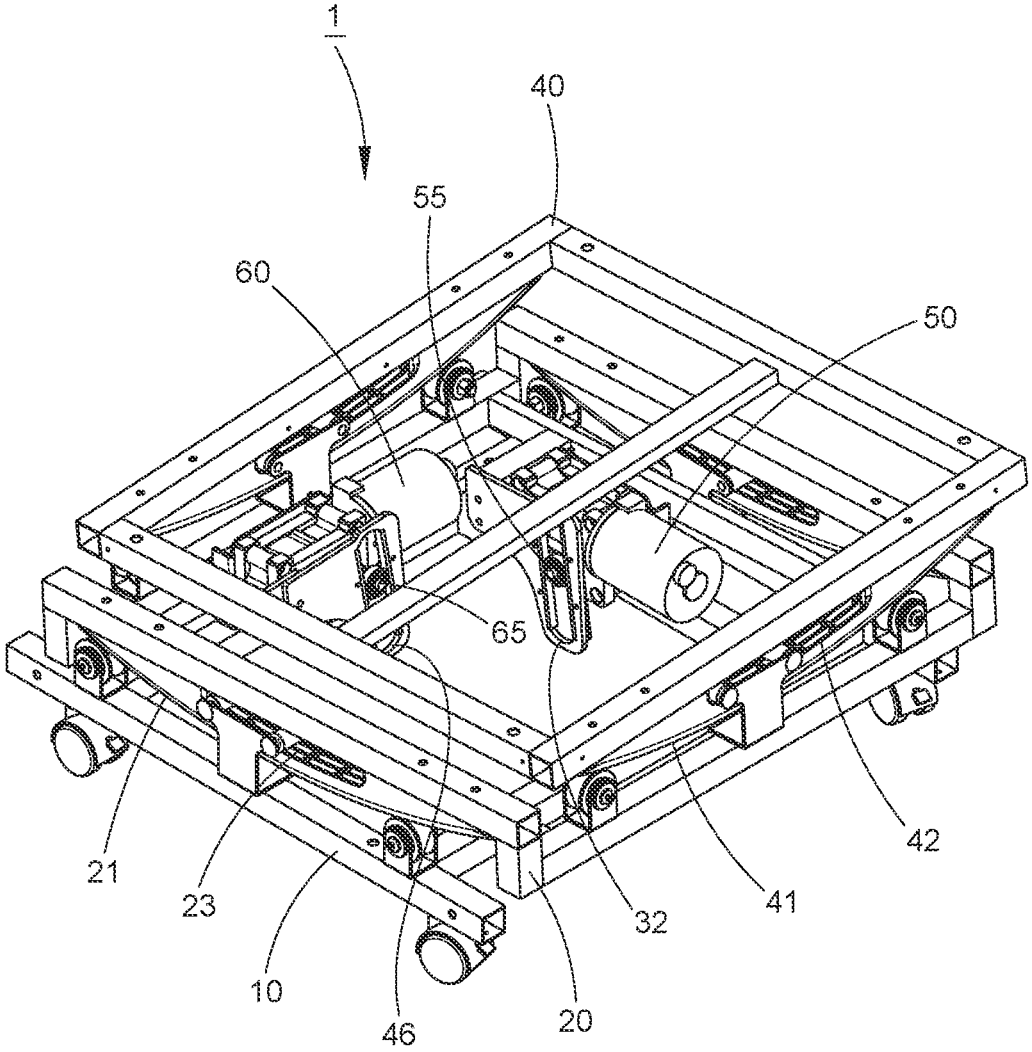
FIGS. 3 to 7 are views showing various states of use.
Figure 4:
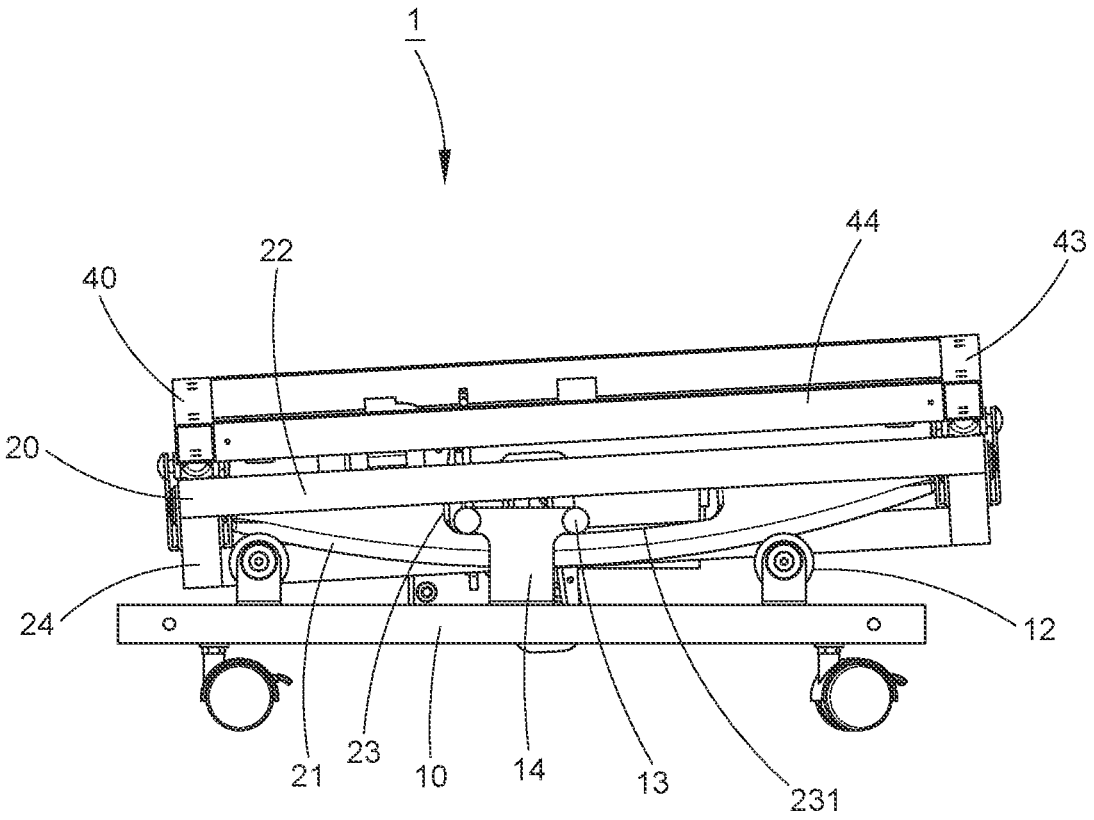
Figure 5:
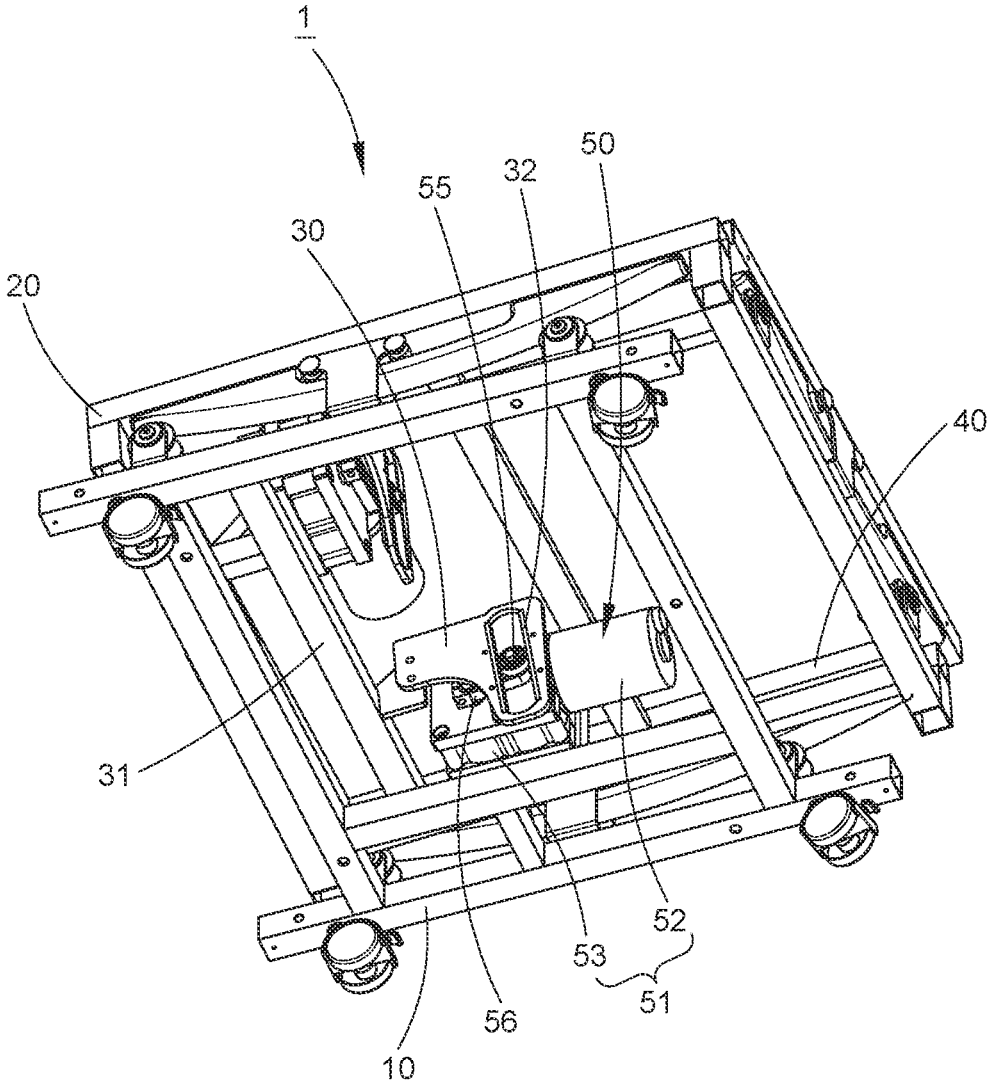

The first actuator 50 is disposed to the fixation base 10 and provided with a first power source 51, a first output shaft 54 extending horizontally from the first power source 51 along the left-and-right direction Y, a first slider 55 accommodated in the first upright guide groove 32, and a first crank 56 connected between the first output shaft 54 and the first slider 55. The first power source 51 includes a first motor 52 and a first transmission mechanism 53 connected between the first motor 52 and the first output shaft 54. Thus, the first actuator 50 can drive the first rocking frame 20 to reciprocatingly move back and forth relative to the fixation base 10 while changing the angle of the first rocking frame 20. As shown in FIGS. 3-5, when the first crank 56 rotates counterclockwise from the position in FIG. 2 to the position in FIG. 5, the first slider 55 can drive the first upright plate 30 and the first rocking frame 20 to move backward. At the same time, the first rocking frame 20 will tilt forward, as shown in FIG. 4. In this embodiment, the first slider 55 is formed or composed of a bearing to reduce friction and ensure smooth operation, but it may be replaced with a block made of engineering plastic or other equivalent materials. The first power source 51 may also be replaced with other equivalent devices.

Figure 6:
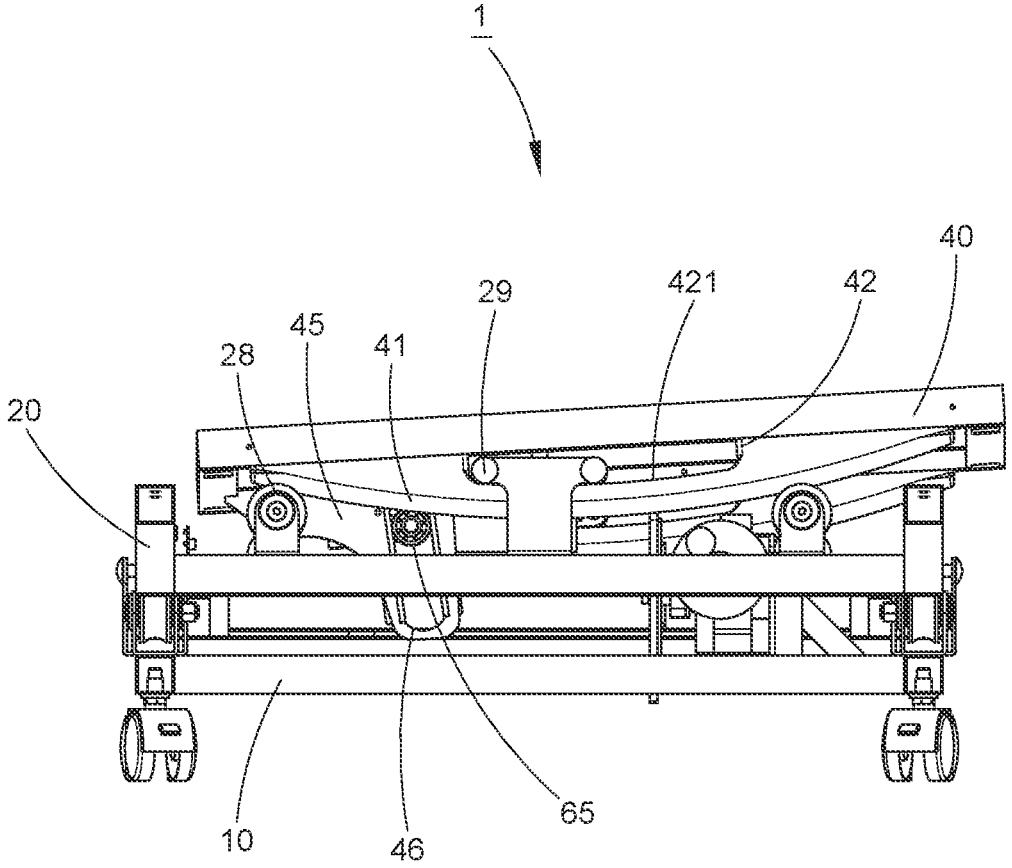
Figure 7:
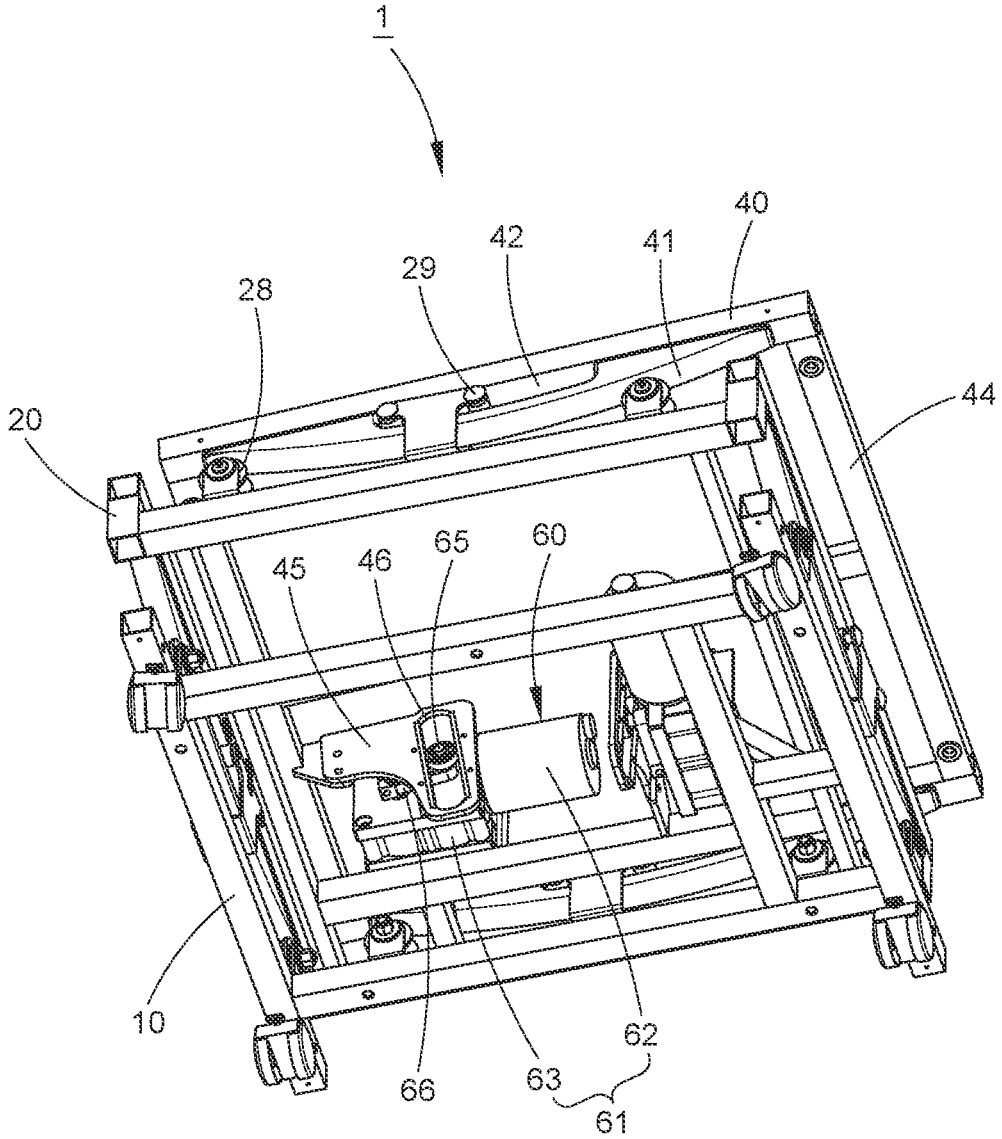

The second actuator 60 is disposed to the first rocking frame 20 and provided with a second power source 61, a second output shaft 64 extending horizontally along the back-and-forth direction X from the second power source 61, a second slider 65 accommodated in the second upright guide groove 46, and a second crank 66 connected between the second output shaft 64 and the second slider 65. The second power source 61 includes a second motor 62 and a second transmission mechanism 63 connected between the second motor 62 and the second output shaft 64. Thus, the second actuator 60 can drive the second rocking frame 40 to reciprocatingly move left and right relative to the first rocking frame 20 while changing the angle of the second rocking frame 40. As shown in FIGS. 3 and 6-7, when the second crank 66 rotates counterclockwise from the position in FIG. 2 to the position in FIG. 7, the second slider 65 can drive the second upright plate 45 and the second rocking frame 40 to move to the right. At the same time, the second rocking frame 40 will tilt towards the left, as shown in FIG. 6. In this embodiment, the second slider 65 is formed or composed of a bearing, but it may be replaced with a block made of engineering plastic or other equivalent materials. The second power source 61 may also be replaced with other equivalent devices.

As a result, when a bed, chair, or sofa is fixed on the base seat 1 provided by the present application, the base seat 1 can simultaneously or separately provide back-and-forth or left-and-right swinging functions, and the frequency of swing in different directions can be adjusted as needed, thereby generating a variety of swinging movements to prevent users from feeling fatigued. Additionally, since the length direction L of the first upright guide groove 32 is approximately vertical, the circular motion of the first slider 55 can be more effectively converted into the back-and-forth swinging motion of the first rocking frame 20 compared to a structure where the length direction is approximately horizontal. Due to the inevitable slight clearance between the first slider 55 and the first upright guide groove 32 caused by dimensional tolerances, there is a tendency for the first rocking frame 20 to experience jerkiness during changes in swinging direction. Therefore, the present invention designs the length direction L of the first upright guide groove 32 to have an included angle of 5° with the vertical direction Z, effectively alleviating the aforementioned jerkiness. Experimental testing has shown that an included angle in the range greater than 0° and less than 12° is effective. The design principle of the second upright guide groove 46 is the same and is not further repeatedly described here. Furthermore, as shown in FIG. 4, the longitudinal grooves 23 restrict the movement range of the first rocking frame 20 relative to the longitudinal limit wheels 13, and as shown in FIG. 6, the transverse grooves 42 restrict the movement range of the second rocking frame 40 relative to the transverse limit wheels 29. This design further enhances the safety of the base seat 1, preventing inadvertent and/or error operation from causing mechanical damage or structural disintegration, thus achieving the objectives of the present invention.

Based on the technical features of the present invention, various modifications to the base seat 1 may be made. For example, the longitudinal limit wheels 13 and associated longitudinal grooves 23, as well as the transverse limit wheels 29 and associated transverse grooves 42, may be omitted. Such variations are not to be regarded as a departure from the spirit and scope of the invention, and all such modifications as would be obvious to one skilled in the art are intended to be included within the scope of the following claims.

What is claimed is:

1. A base seat for being used with a bed, a chair, or a sofa, the base seat comprising:

a fixation base provided thereon with two longitudinal wheel sets arranged in a back-and-forth direction, each of the longitudinal wheel sets comprising two longitudinal support wheels;

a first rocking frame comprising two longitudinal arc rails extending in the back-and-forth direction and being in contact with top sides of the longitudinal support wheels, and a first upright guide groove; on the first rocking frame, two transverse wheel sets are arranged in a left-and-right direction and each comprise two transverse support wheels;

a second rocking frame comprising two transverse arc rails extending in the left-and-right direction and being in contact with top sides of the transverse support wheels, and a second upright guide groove;

a first actuator disposed to the fixation base and provided with a first output shaft, a first slider disposed in the first upright guide groove, and a first crank connected between the first output shaft and the first slider, such that the first actuator drives the first rocking frame to reciprocatingly move back and forth relative to the fixation base while changing an angle of the first rocking frame; and a second actuator disposed to the first rocking frame and provided with a second output shaft, a second slider disposed in the second upright guide groove, and a second crank connected between the second output shaft and the second slider, such that the second actuator drives the second rocking frame to reciprocatingly move left and right relative to the first rocking frame while changing an angle of the second rocking frame.

2. The base seat of claim 1, wherein each of the two longitudinal wheel sets of the fixation base comprises a longitudinal limit wheel located between the two longitudinal support wheels; the first rocking frame comprises two longitudinal grooves above the two longitudinal arc rails, respectively; the longitudinal limit wheels are received in the longitudinal grooves, respectively.

3. The base seat of claim 2, wherein each of the two longitudinal grooves comprises an arc bottom in contact with one of the longitudinal limit wheels.

4. The base seat of claim 1, wherein the first rocking frame comprises two upper rods parallel to each other and connected with the two longitudinal arc rails respectively, four downwardly extending portions extending downwardly from two ends of the two upper rods respectively, a front rod connected with two of the four downwardly extending portions, and a rear rod connected with the other two of the four downwardly extending portions; the two transverse wheel sets are disposed on the front rod and the rear rod, respectively.

5. The base seat of claim 1, wherein each of the two transverse wheel sets of the first rocking frame comprises a transverse limit wheel located between the two transverse support wheels; the second rocking frame comprises two transverse grooves above the two transverse arc rails, respectively; the transverse limit wheels are received in the transverse grooves, respectively.

6. The base seat of claim 5, wherein each of the two transverse grooves comprises an arc bottom in contact with one of the transverse limit wheels.

7. The base seat of claim 1, wherein the first upright guide groove extends in a straight line defining with a plumb line an included angle greater than 0° and smaller than 12°.

8. The base seat of claim 1, wherein the second upright guide groove extends in a straight line defining with a plumb line an included angle greater than 0° and smaller than 12°.

9. The base seat of claim 1, wherein the first actuator comprises a first power source, and the first output shaft extends horizontally from the first power source in the left-and-right direction.

10. The base seat of claim 9, wherein the first power source comprises a first motor, and a first transmission mechanism connected between the first motor and the first output shaft.

11. The base seat of claim 1, wherein the first slider comprises a bearing.

* * * * *